US005897425A

United States Patent [19]

Fisher, Jr. et al.

[11] Patent Number: 5,897,425

[45] Date of Patent: Apr. 27, 1999

[54] VERTICAL POLISHING TOOL AND METHOD

[75] Inventors: Thomas Robert Fisher, Jr., Beacon; Carol Elaine Christine Gustafson, Poughkeepsie; William Francis Landers; John Carlo Minunni, Jr., both of Wappingers Falls; Thomas Edwin Sandwick, Hopewell Junction; Adam Dan Ticknor, Wappingers Falls, all of N.Y.

[73] Assignee: International Business Machines Corporation, Armonk, N.Y.

[21] Appl. No.: 08/846,976

[22] Filed: Apr. 30, 1997

[51] Int. Cl.[6] ..... B24B 1/00; B24B 7/19

[52] U.S. Cl. ..... 451/41; 451/287; 451/289

[58] Field of Search ..... 451/21, 5, 6, 7, 451/8, 9, 10, 11, 56, 285, 286, 287, 288, 289, 268, 269

[56] References Cited

U.S. PATENT DOCUMENTS

| | | | |
|---|---|---|---|
| 2,933,437 | 5/1960 | Loosme . | |
| 3,182,428 | 5/1965 | Hannon | 451/269 |
| 3,748,677 | 7/1973 | Frank et al. . | |
| 4,208,760 | 6/1980 | Dexter et al. | 15/302 |
| 4,393,628 | 7/1983 | Ottman et al. . | |
| 4,934,102 | 6/1990 | Leach et al. . | |
| 5,317,778 | 6/1994 | Kudo et al. . | |
| 5,422,316 | 6/1995 | Desai et al. | 437/228 |
| 5,456,627 | 10/1995 | Jackson et al. | 451/11 |
| 5,468,302 | 11/1995 | Thietje . | |
| 5,486,129 | 1/1996 | Sandhu et al. . | |
| 5,498,196 | 3/1996 | Karlsrud et al. . | |
| 5,664,987 | 9/1997 | Renteln | 451/21 |
| 5,665,201 | 9/1997 | Sahota | 438/693 |

*Primary Examiner*—David A. Scherbel
*Assistant Examiner*—Derris Holt Banks
*Attorney, Agent, or Firm*—Schmeiser, Olsen & Watts; Howard J. Walter, Jr.

[57] ABSTRACT

A vertically-oriented wafer polishing apparatus and method is disclosed including a vertically-oriented polishing device, a semiconductor wafer carrier and a cleaning module to clean the polishing device by removing contaminants that may scratch the wafer and also reduce the polishing rate of the apparatus. The device reduces the "down time" of a polishing apparatus and, therefore, increases the yield of well-polished wafers in a given time period.

67 Claims, 5 Drawing Sheets

VERTICAL POLISHING TOOL AND METHOD

BACKGROUND OF THE INVENTION

1. Technical Field

The present invention relates generally to a chemical mechanical polishing (CMP) method and machine. More specifically, the present invention relates to a process and machine for polishing semiconductor wafers using a vertically-oriented polisher with a cleaning module for the polisher.

2. Related Art

Current CMP tool design usually includes one or more horizontally oriented polishing pads which are rotated and saturated with a slurry solution as a rotating wafer is pressed into contact with the pad. As the pad rotates, the wafer is polished. However, as the current polishing processes progress, film residuals, slurry agglomerations, pad debris and other foreign material become intermixed with the slurry and oftentimes become embedded within the pad material. As a result, the residuals, agglomerations, and debris can cause wafer scratching.

To prevent this problem, the current pad cleaning and conditioning techniques typically polish the wafers and then remove the wafer scratching particles after the wafers are removed to avoid interaction between the cleaning and polishing processes. Unfortunately, this technique slows the overall speed of the CMP process by imparting a "down time" for removal of the wafer scratching particles. As a result, the yield of polished wafers for a given polishing device is greatly reduced.

SUMMARY OF THE INVENTION

It is an advantage of the invention to provide a unique apparatus and method to solve the above noted problems. In the invention, a polishing tool for semiconductor wafers is provided including a vertically-oriented polishing device, a semiconductor wafer holder, and a polishing device cleaning/conditioning module for the polishing device.

The provision of the cleaning/conditioning module prevents film residues, slurry agglomerations, pad debris and other foreign material from becoming intermixed with the slurry which is delivered to the polishing device/wafer interface to assist in the polishing process. Cleansing/conditioning of the polishing device is further assisted by the verticality of the polishing device since gravity causes undesired contaminants to fall away from the polishing surface. Accordingly, as the polishing process continues the present invention prevents the initial embedding of contaminants in the polishing device, hence, increasing the polishing rate of the polishing device. Furthermore, gravity assists the cleaning process in that once the contaminants are removed from the polishing device by the cleaning module, they settle away from the polishing device thus further segregating the insitue cleaning process from the polishing operation. As a result, the required "down time" of a given polishing device is greatly reduced and, accordingly, the yield of well-polished wafers is increased.

The polishing device may take a variety of forms without departing from the scope of the present invention. For example, in one preferred embodiment, the polishing device is a polishing pad which is mounted to a substantially circular polishing table that rotates about a substantially horizontal axis. In order to rotate the polishing device in accordance with the present invention, a variety of drive mechanisms are envisioned. For instance, the polishing table may be provided with a centrally positioned motor-driven shaft. Alternatively, the polishing table may be supported by a plurality of wheels in contact with the outer periphery of the table with at least one of the wheels being driven to rotate the table.

As a second alternative in accordance with the invention, the polishing table may be provided with a plurality of gear teeth on its outer periphery. To support and drive the table in this setting two alternatives are envisioned. First, a set of gear wheels can be mounted adjacent to the polishing table with each gear meshing with at least one of the gear teeth of the polishing table. To rotatably drive the table, one of the supporting gears is driven. Second, in order to rotatably support and drive rotation of the table, a frame may be provided with a bearing between the frame and the outer periphery of the polishing table. A driven gear that meshes with at least one of the plurality of gear teeth on the outer periphery of the polishing table is then provided to rotate the table. The bearing may advantageously include at least one bearing race formed in the outer periphery of the table and at least one bearing race formed in the frame for assuring smooth rotation of the table.

It is also envisioned that the polishing device could be in the form of a belt polisher without departing from the scope of the invention.

Regardless of the type of polishing device, semiconductor wafers are held parallel to and in contact with the polishing device to polish the semiconductor wafer. In this regard, the semiconductor wafer may be held, for example, with a rotatable semiconductor wafer carrier. Polishing can, therefore, be further enhanced since both the polishing device and wafer are moving. Furthermore, polishing can be enhanced by having the carrier provide pressure to the wafer to force it against the polishing device.

The cleaning module in accordance with the present invention may also take a variety of forms to assure the removal of contaminants. For instance, the cleaning module could be a fluid bath, a spray head, a conditioning plate, a brush or any combinaiton of the above. If a fluid bath is provided, it is envisioned that the bath may further include a fluid agitating mechanism such as an ultrasonic or meg transducer. Furthermore, to aid in the segregation of undesired contaminants it is also advantageous to locate the cleaning module at a position opposite but not above the wafer/polishing device contact area so that the polishing device can be cleaned/conditioned without debris falling into the polishing area. Furthermore, according to the invention, the cleaning module may be positioned directly below the wafer/polishing device contact area so that contaminants falling from the polishing area can be caught by the cleaning module.

In the process according to the invention, polishing of semiconductor wafers is provided with the steps of: polishing semiconductor wafers with a polishing device while holding the wafers in contact with the polishing device and cleaning the polishing device during the step of polishing. In order to assure high quality polishing, the method according to the present invention may also provide the step of rotatably holding the semiconductor wafer in contact with the polishing device. As discussed with regard to the apparatus of the present invention, the step of cleaning the polishing device can be provided by a variety of processes such as a fluid bath, spraying, conditioning with a plate, brushing or any combinaiton of the above. Also, as noted above, if a fluid bath is provided, it is envisioned that the bathing step may further include a fluid agitating step such as that provided by ultrasonic or meg transducers.

The foregoing and other features and advantages of the invention will be apparent from the following more particular description of preferred embodiments of the invention.

BRIEF DESCRIPTION OF THE DRAWINGS

The preferred embodiments of this invention wil be described in detail, with reference to the following figures, wherein like designations denote like elements, and wherein.

DESCRIPTION OF THE PREFERRED EMBODIMENTS

Although the present invention will be described with regard to a wafer polishing pad, it should be understood that the present invention is equally useful in other types of polishing machines, such as a belt polisher.

Figure 1:
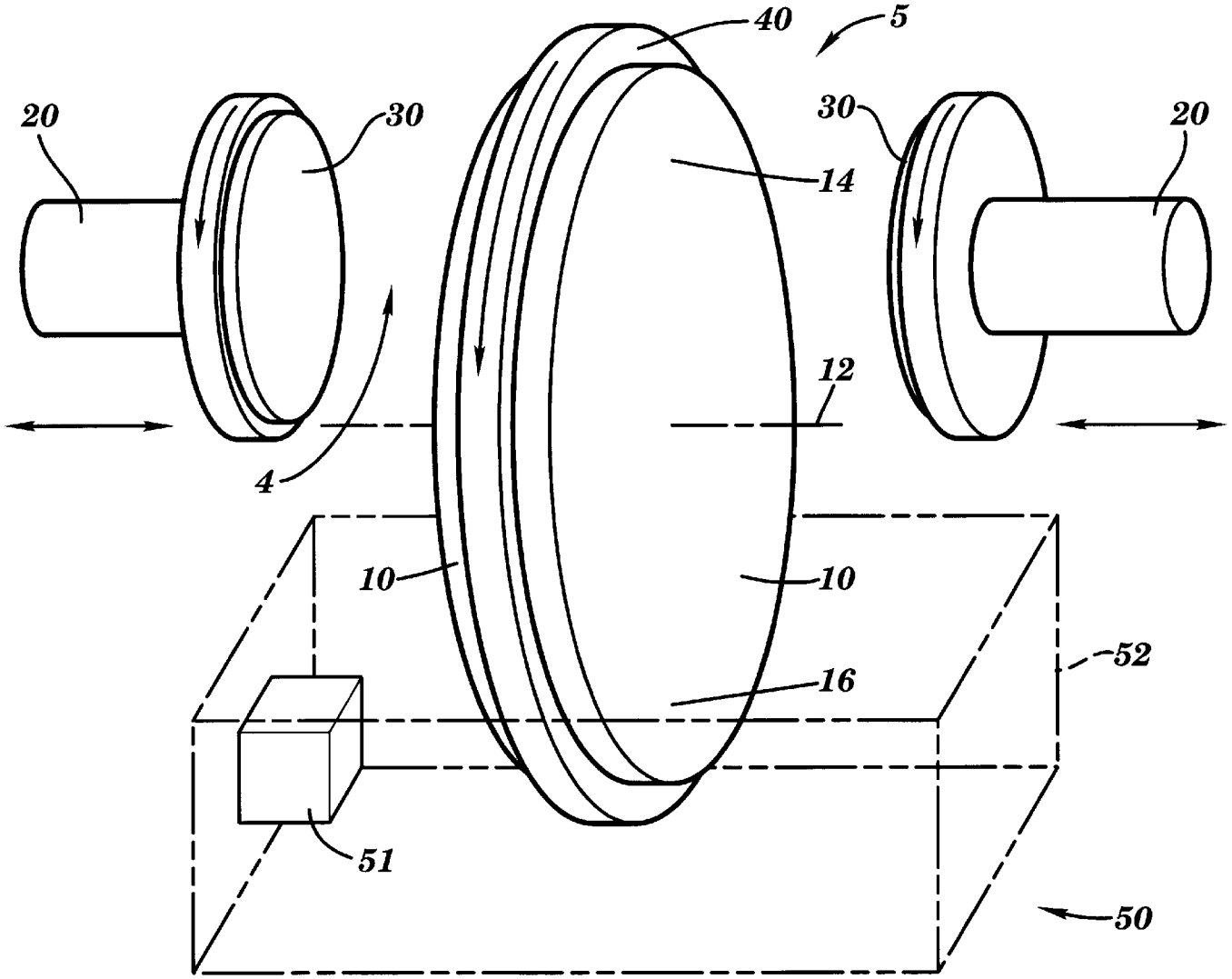
FIG. 1 is a perspective view of a wafer polishing system in accordance with a first embodiment of the present invention.

FIG. 1 depicts a wafer polishing system in accordance a preferred embodiment of the present invention. It will be understood that the system has two identical sides for duplicating the polishing process, however, for simplicity sake, operation will be described for only one side.

In this preferred embodiment, a polishing device 5 is provided in the form of a vertically-oriented, rotatable table 40 having mounted thereto at least one polishing pad 10 on the side thereof. The table 40 is driven to rotate about a centrally located horizontal axis 12 by a variety of drive systems discussed hereafter. As the table and polishing pad 10 rotate, semiconductor wafer(s) 30 are brought into contact with the polishing pad 10 by a carrier 20.

Figure 2:
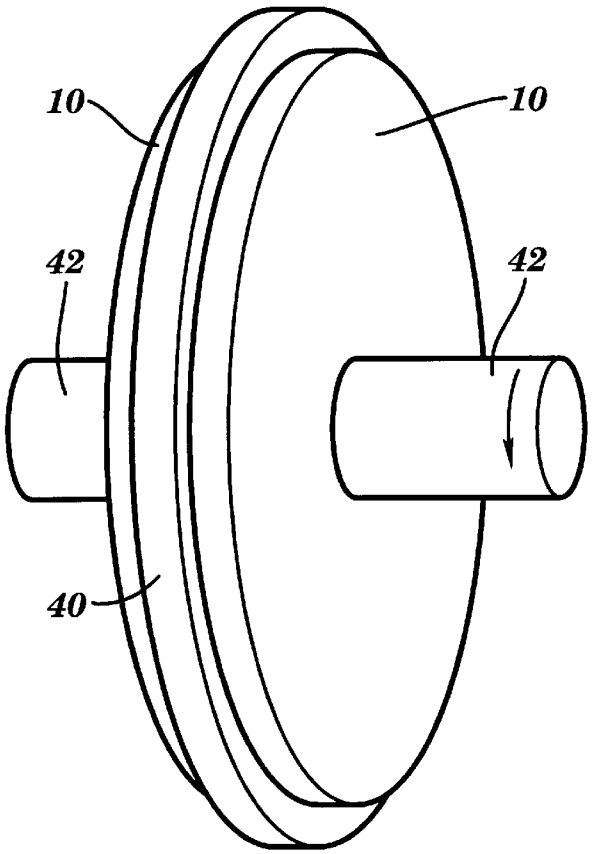
FIG. 2 is a perspective view of a polishing table according to a first embodiment of the present invention.

The rotatable table 40 may be driven by a variety of devices. In the embodiment of FIG. 2, the table 40 is provided with a centrally positioned drive shaft 42 that extends from the center of the table and through the pads 10 attached thereto. While two shafts are shown, it should be understood that one drive shaft extending from either side of the table 40 may just as easily be provided to drive the table.

Figure 3:
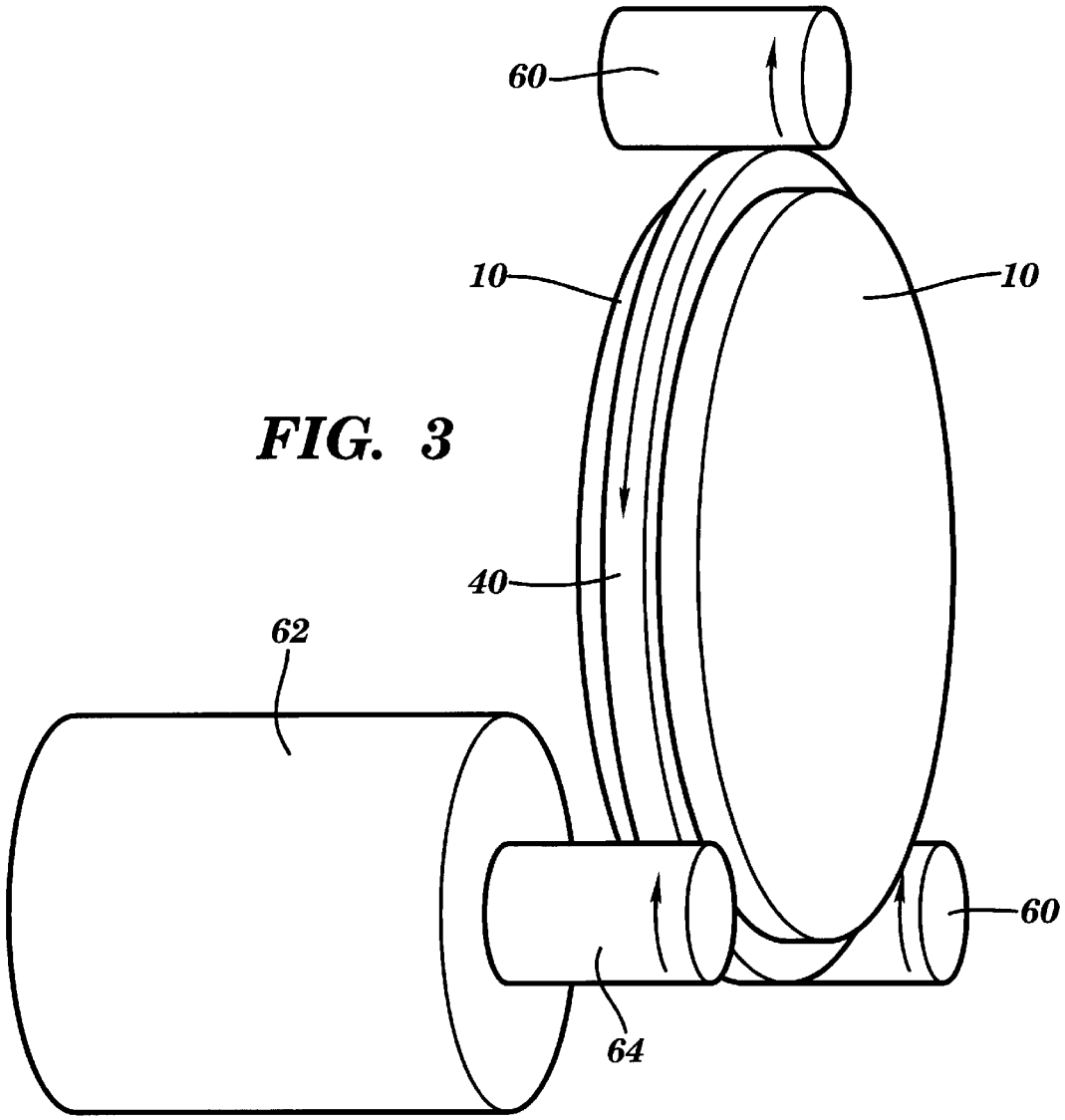
FIG. 3 is a perspective view of a polishing table according to a second embodiment of the present invention.

FIG. 3 shows a table drive system including a plurality of wheels 60 that contact the outer periphery of and support the rotatable table 40. To drive the table, at least one of the wheels 64 is driven by a motor 62.

Figure 4:
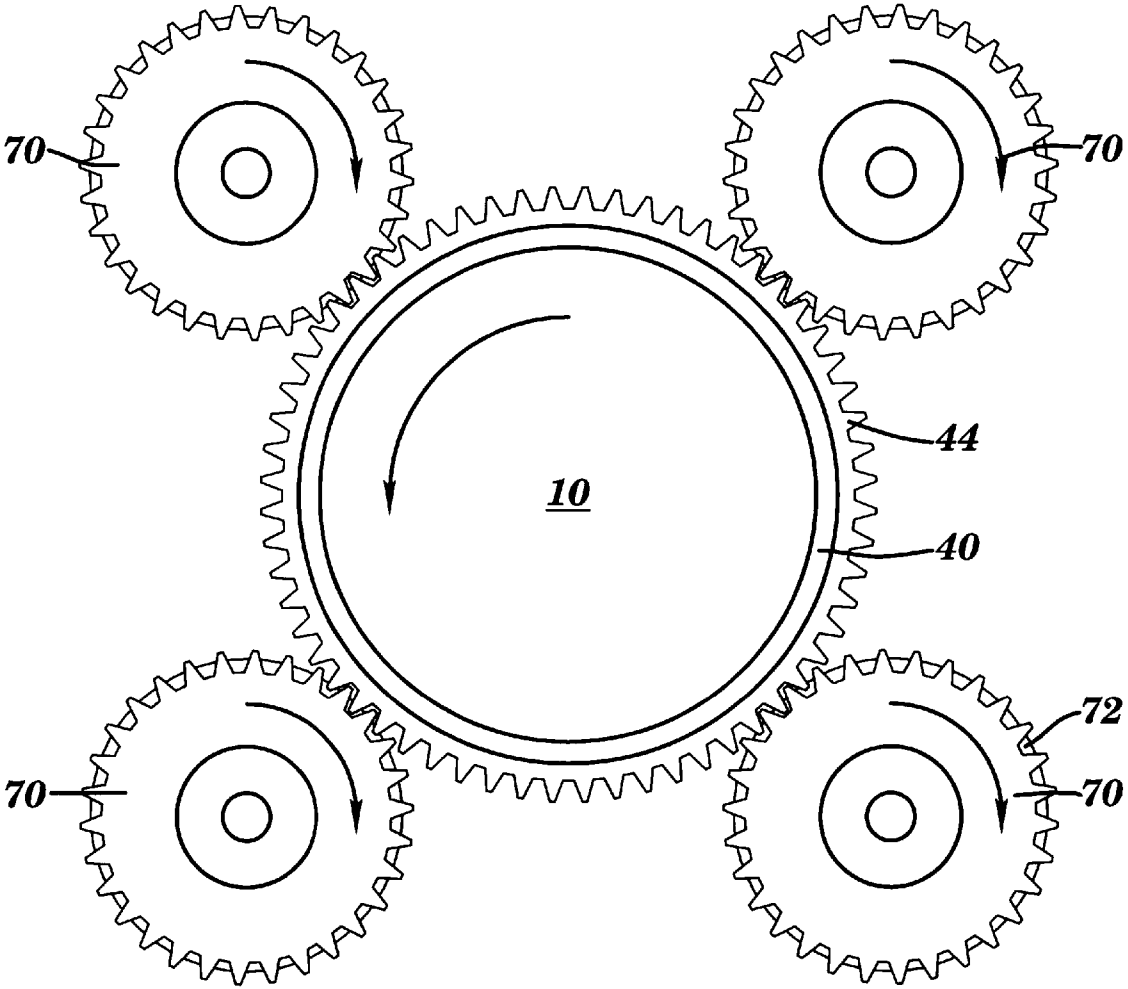
FIG. 4 is a side view of a polishing table according to a third embodiment of the present invention.

FIG. 4 shows another table drive system in which the outer periphery of the table 40 is provided with gear teeth 44. The table 40 is supported by a plurality of gear wheels 70 which include teeth that mesh with the teeth 44 on the outer periphery of the table 40. In order to rotate the table, at least one of the gear wheels 70 is driven to rotate by a motor 72.

Figure 5:
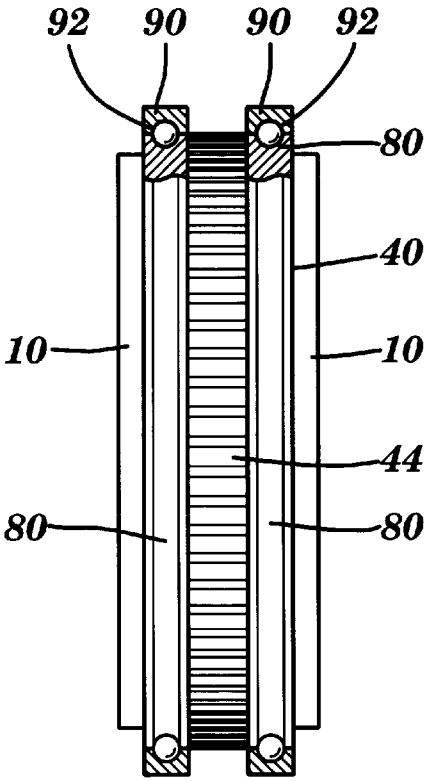
FIG. 5 is a plan view of a polishing table according to a fourth embodiment of the present invention.

FIG. 5 shows another mechanism to drive the table 40. In this embodiment, the table 40 is supported for rotation on a frame 90 which includes at least one bearing race 92. At least one complementary bearing race 80 is provided on the outer periphery of the table 40 so that the table can rotate on the frame 90. To drive the table 40, the outer periphery of the table 40 is further provided with gear teeth 44 such that a driven gear wheel 70, as shown in FIG. 4, can mesh with the table 40 to rotate the table.

Returning to FIG. 1, the semiconductor wafer carrier 20 maintains the wafer(s) 30 parallel to the polishing pad 10 and also may rotate the wafer(s) 30 about a horizontal axis of the carrier 20. This dual rotation of the polishing pad 10 and wafer(s) 30 assures high quality polishing. Furthermore, as will be understood by one having ordinary skill in the art, the carrier 20 can be adapted to apply pressure to the wafers to further assist in the polishing.

During the polishing process, polishing slurry (not shown) may also be delivered to the polishing pad/wafer interface to assist in the polishing process. The slurry, as will be understood by one having ordinary skill in the art, may be introduced through the polishing table 40 or at the interface of the leading edge of the wafer carrier and polishing table via a nozzle assembly (not shown).

Figure 6:
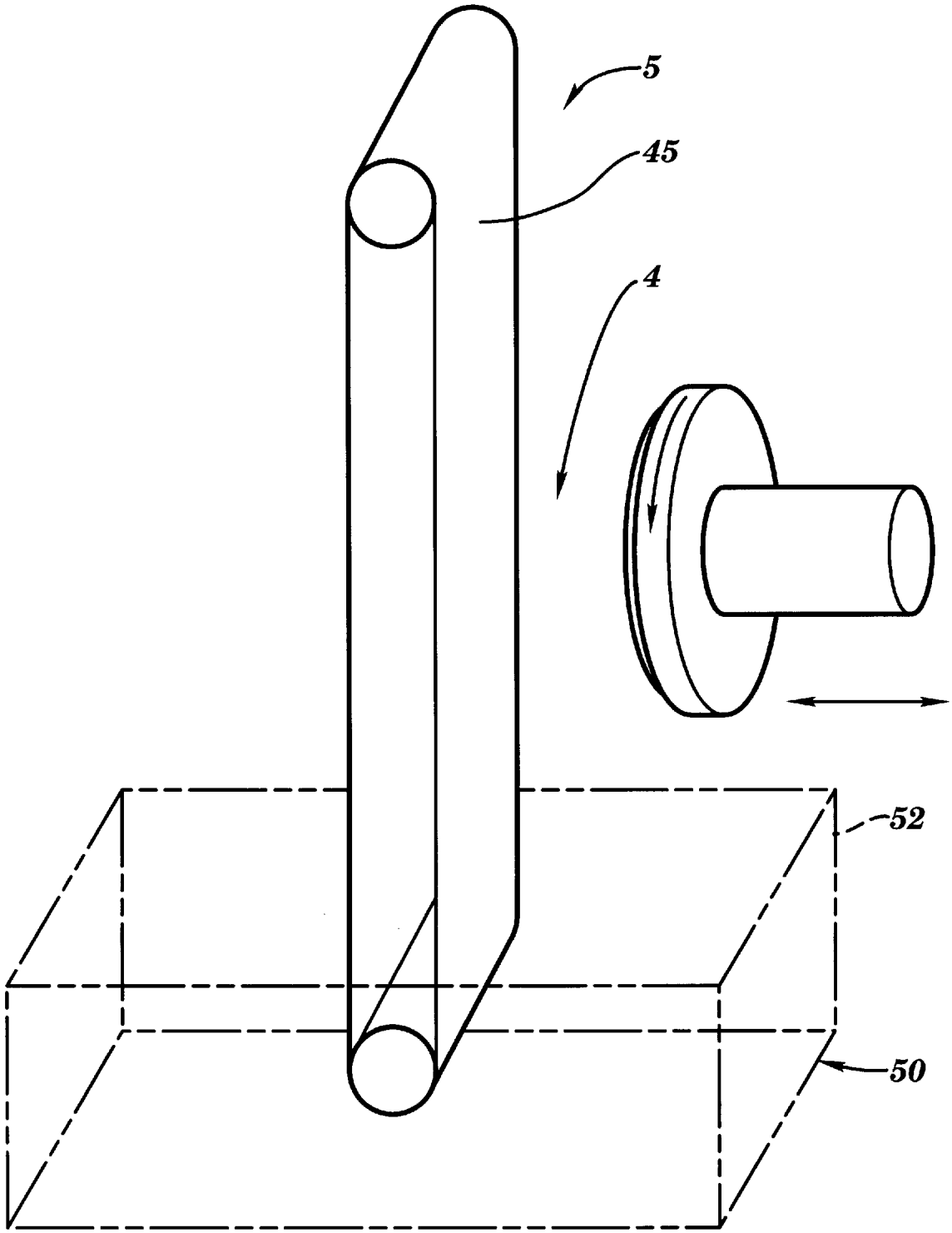
FIG. 6 is a perspective view of wafer polishing system according to a second embodiment of the invention.

Although the polishing device 5 is presented here as a rotatable table 40, it should be noted that other vertically-oriented polishing devices may be provided without departing from the scope of the invention. For instance, FIG. 6 shows the polishing device 5 may take the form of a vertically-oriented polishing belt 45.

To prevent accumulation or embedding of contaminants, such as film residuals, slurry agglomerations, pad debris and other foreign material, in the polishing device and to prevent the above listed contaminants from becoming intermixed with the slurry, a pad cleaning module 50 is provided oppositely the polishing area 4. As shown in FIG. 1, the cleaning module 50 may be positioned at a lower portion 16 of the polishing pad 10 below the polishing area 4 near an upper portion 14 of the polishing pad 10. In this position, the cleaning module is advantageously positioned to catch contaminants falling from the polishing area 4. It should be noted, however, that the cleaning module may also be positioned at any location opposite the polishing area 4 so that the polishing device can be cleansed/conditioned before entering the polishing area 4.

Figure 9:
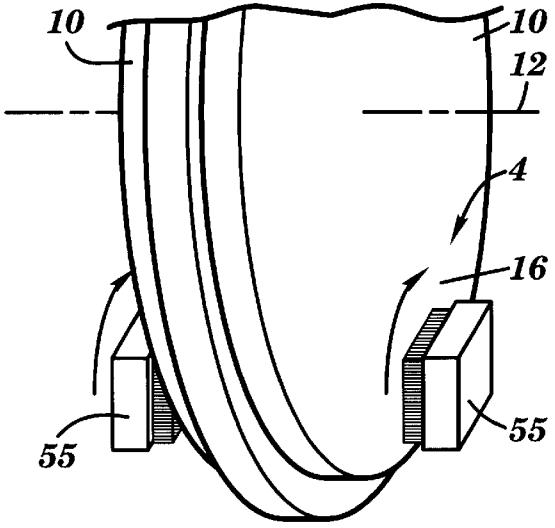
FIG. 9 is a perspective view of a fourth embodiment for the cleaning module according to the present invention.
Figure 8:
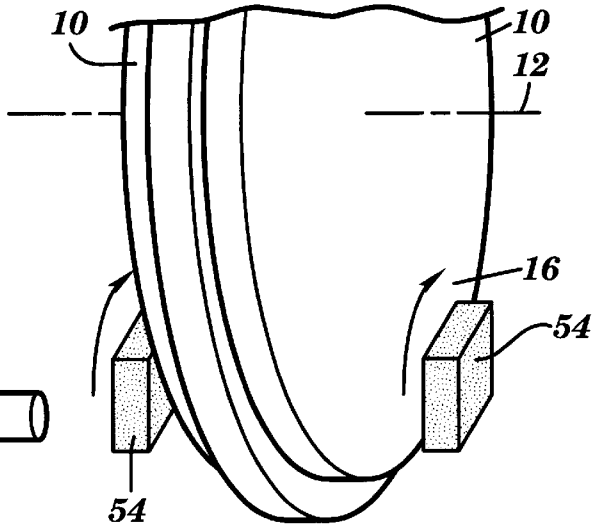
FIG. 8 is a perspective view of a third embodiment for the cleaning module according to the present invention.
Figure 7:
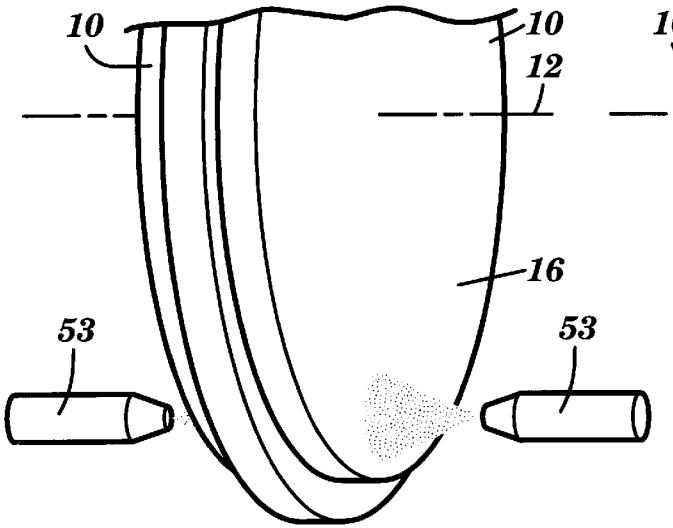
FIG. 7 is a perspective view of a second embodiment for the cleaning module according to the present invention.

The cleaning module in accordance with the present invention may take a variety of forms. FIGS. 1 and 6, for instance, show the cleaning module in the form of a fluid bath. FIG. 7 shows the cleaning module in the form of a spray head 53. FIG. 8 shows the cleaning module in the form of a conditioning plate 54. FIG. 9 shows the cleaning module in the form of a brush 55. It should also be noted that the cleaning module can be any combination of the above disclosed devices that may be found necessary to satisfactorily clean, condition or maintain the polishing device. Furthermore, other well known cleaning enhancing techniques/devices may be provided in conjunction with the above devices to aid in cleaning. For instance, if a fluid bath is selected, a meg or ultrasonic transducer 51, as shown in FIG. 1, may also be provided to agitate the fluid to further assist in the cleaning of the polishing device. If a conditioning plate 54 or brush 55 is selected, either can be rotatably driven to aid in cleaning/conditioning.

While this invention has been described in conjunction with the specific embodiments outlined above, it is evident that many alternatives, modifications and variations will be apparent to thosed skilled in the art. Accordingly, the preferred embodiments of the invention as set forth above are intended to be illustrative, not limiting. Various changes may be made without departing from the spirit and scope of the invention as defined in the following claims.

We claim:

1. An apparatus comprising:

a vertically-oriented rotatable semiconductor polishing device including at least two polishing surfaces facing away from each other;

at least two semiconductor wafer carriers, each semiconductor wafer carrier holding at least one semiconductor wafer in contact with and parallel to a polishing area of one of the polishing surfaces; and a polishing device cleaning module for cleaning the polishing device.

2. The apparatus of claim 1, wherein each of the semiconductor wafer carriers is adapted to apply pressure to the at least one wafer.

3. The apparatus of claim 1, wherein the cleaning module is positioned oppositely the polishing surfaces.

4. The apparatus of claim 3, wherein the cleaning module is positioned vertically below the polishing surfaces.

5. The apparatus of claim 1, wherein each of the semiconductor wafer carriers rotates the at least one wafer.

6. The apparatus of claim 1, further including a slurry delivery system having an outlet adjacent to the polishing areas.

7. The apparatus of claim 1, wherein the polishing device is a polishing pad.

8. The apparatus of claim 7, wherein the polishing pad is mounted to a vertically-oriented, substantially circular polishing table; the table being rotatable about a horizontal axis.

9. The apparatus of claim 8, wherein the polishing table includes a centrally positioned drive shaft, the drive shaft being rotatably driven by a motor to rotate the table.

10. The apparatus of claim 9, wherein the polishing table further includes a plurality of gear teeth on the outer periphery of the polishing table.

11. The apparatus of claim 10, further including a plurality of gears mounted adjacent to the polishing table; each gear meshing with at least one of the gear teeth of the polishing table; and wherein one of the plurality of gears is driven by a motor to drive the polishing table.

12. The apparatus of claim 10, further including:

a frame for supporting the polishing table;

a bearing between the frame and the outer periphery of the polishing table; and a driven gear that meshes with at least one of the plurality of gear teeth on the periphery of the polishing table to rotate the table.

13. The apparatus of claim 12, wherein the bearing includes at least one bearing race formed in the outer periphery of the table and at least one bearing race formed in the frame.

14. The apparatus of claim 12, wherein the fluid bath includes an ultrasonic transducer.

15. The apparatus of claim 12, wherein the fluid bath includes a meg transducer.

16. The apparatus of claim 8, wherein the polishing table is supported by a plurality of wheels in contact with the outer periphery of the polishing table, and wherein at least one of the plurality of wheels is a driven wheel that causes the table to rotate.

17. The apparatus of claim 1, wherein the pad cleaning module is a fluid bath.

18. The apparatus of claim 1, wherein the pad cleaning module is a spray head.

19. The apparatus of claim 1, wherein the pad cleaning module is a conditioning plate.

20. The apparatus of claim 1, wherein the pad cleaning module is a brush.

21. A method of polishing a semiconductor wafer comprising the steps of:

polishing at least one semiconductor wafer with a vertically-oriented polishing device that rotates about a horizontal axis and includes at least two polishing surfaces facing in opposite directions;

rotatably holding the at least one semiconductor wafer in contact with and parallel to each polishing surface of the polishing device; and cleaning the polishing device with a cleaning module.

22. The method of claim 21, wherein the step of cleaning the polishing device includes moving the polishing device through a fluid bath.

23. The method of claim 22, wherein the fluid bath includes one of an ultrasonic transducer and a meg transducer.

24. The method of claim 21, wherein the step of cleaning the polishing device includes moving the polishing device through a spray head.

25. The method of claim 21, wherein the step of cleaning the polishing device includes moving the polishing device in contact with a conditioning plate.

26. The method of claim 21, wherein the step of cleaning the polishing device includes moving the polishing device in contact with a brush.

27. An apparatus comprising:

a vertically-oriented rotatable semiconductor polishing device including a polishing surface on each side of a rotatable table;

means for holding a semiconductor wafer in contact with at least one polishing surface; and means for cleaning the means for polishing.

28. The apparatus of claim 27, wherein the means for holding semiconductor wafer is adapted to apply pressure to the at least one wafer.

29. The apparatus of claim 27, wherein the means for cleaning is positioned oppositely of the polishing surfaces.

30. The apparatus of claim 27, wherein the means for cleaning is positioned vertically below the polishing surfaces.

31. The apparatus of claim 27, wherein the means for holding semiconductor wafer rotates the at least one wafer.

32. The apparatus of claim 27, further including means for delivery of a slurry adjacent the polishing areas.

33. The apparatus of claim 27, wherein the polishing surfaces are polishing pads.

34. The apparatus of claim 33, wherein the rotatable table is circular and rotatable about a horizontal axis.

35. The apparatus of claim 34, wherein the rotatable table further includes a plurality of gear teeth on the outer periphery of the rotatable table.

36. The apparatus of claim 35, further including a plurality of gears mounted adjacent to the rotatable table; each gear meshing with at least one of the gear teeth of the table; and wherein one of the plurality of gears is driven by a motor to drive the table.

37. The apparatus of claim 35, further including:

a frame for supporting the rotatable table; and a bearing between the frame and the outer periphery of the rotatable table; and a driven gear that meshes with at least one of the plurality of gear teeth on the periphery of the rotatable table to rotate the table.

38. The apparatus of claim 37, wherein the bearing includes at least one bearing race formed in the outer periphery of the table and at least one bearing race formed in the frame.

39. The apparatus of claim 27, wherein the rotatable table includes a centrally positioned drive shaft, and the drive shaft is rotatably driven by a motor to rotate the table.

40. The apparatus of claim 27, wherein the polishing table is supported by a plurality of wheels in contact with the outer periphery of the rotatable table; and wherein at least one of the plurality of wheels is a driven wheel that causes the table to rotate.

41. The apparatus of claim 27, wherein the means for cleaning is a fluid bath.

42. The apparatus of claim 41, wherein the fluid bath includes an ultrasonic transducer.

43. The apparatus of claim 41, wherein the fluid bath includes a meg transducer.

44. The apparatus of claim 27, wherein the means for cleaning is a spray head.

45. The apparatus of claim 27, wherein the means for cleaning is a conditioning plate.

46. The apparatus of claim 27, wherein the means for cleaning is a brush.

47. An apparatus comprising:

a semiconductor polishing device positionable proximate a semiconductor wafer, said wafer having a first axis of rotation, the polishing device having an endless conveyor with a second and third axis of rotation, wherein the first axis of rotation is angularly offset from and nonparallel to the second and third axis of rotation; and a polishing device cleaning module for cleaning a polishing device.

48. An apparatus comprising:

a vertically-oriented rotatable semiconductor polishing device including a polishing surface on each side of a rotatable table;

a plurality of semiconductor wafer carriers for holding at least one semiconductor wafer in contact with at least one polishing area of each of the polishing surfaces; and a polishing device cleaning module for cleaning the polishing device.

49. The apparatus of claim 48, wherein each of the plurality of semiconductor wafer carriers is adapted to apply pressure to the at least one wafer.

50. The apparatus of claim 48, wherein the cleaning module is positioned oppositely the polishing surfaces.

51. The apparatus of claim 50, wherein the cleaning module is positioned vertically below the polishing surfaces.

52. The apparatus of claim 48, wherein each of the plurality of semiconductor wafer carriers rotates the at least one wafer.

53. The apparatus of claim 48, further including a slurry delivery system having an outlet adjacent to the polishing areas.

54. The apparatus of claim 48, wherein the polishing surfaces are polishing pads.

55. The apparatus of claim 54, wherein the rotatable table is circular and is rotatable about a horizontal axis.

56. The apparatus of claim 48, wherein the rotatable table includes a centrally positioned drive shaft, the drive shaft being rotatably driven by a motor to rotate the table.

57. The apparatus of claim 48, wherein the rotatable table is supported by a plurality of wheels in contact with the outer periphery of the rotatable table, and wherein at least one of the plurality of wheels is a driven wheel that causes the table to rotate.

58. The apparatus of claim 48, wherein the rotatable table further includes a plurality of gear teeth on the outer periphery of the rotatable table.

59. The apparatus of claim 58, further including a plurality of gears mounted adjacent to the rotatable table; each gear meshing with at least one of the gear teeth of the rotatable table; and wherein one of the plurality of gears is driven by a motor to drive the rotatable table.

60. The apparatus of claim 58, further including:

a frame for supporting the rotatable table;

a bearing between the frame and the outer periphery of the rotatable table; and a driven gear that meshes with at least one of the plurality of gear teeth on the periphery of the rotatable table to rotate the table.

61. The apparatus of claim 60, wherein the bearing includes at least one bearing race formed in the outer periphery of the table and at least one bearing race formed in the frame.

62. The apparatus of claim 60, wherein the fluid bath includes an ultrasonic transducer.

63. The apparatus of claim 60, wherein the fluid bath includes a meg transducer.

64. The apparatus of claim 48, wherein the pad cleaning module is a fluid bath.

65. The apparatus of claim 48, wherein the pad cleaning module is a spray head.

66. The apparatus of claim 48, wherein the pad cleaning module is a conditioning plate.

67. The apparatus of claim 48, wherein the pad cleaning module is a brush.

* * * * *